US009663961B2

(12) United States Patent
Moeller et al.

(10) Patent No.: US 9,663,961 B2
(45) Date of Patent: May 30, 2017

(54) CURTAIN WALL PANEL INSTALLATION SYSTEM

(71) Applicant: Illinois Tool Works Inc., Glenview, IL (US)

(72) Inventors: Larry Moeller, Schaumburg, IL (US); Stanislaw Piotrowski, Addison, IL (US); Mark Kurth, Beverly Shores, IN (US); Vince Bowman, Highland Park, IL (US); Scott Rote, Mokena, IL (US)

(73) Assignee: Illinois Tool Works Inc., Glenview, IL (US)

( * ) Notice: Subject to any disclaimer, the term of this patent is extended or adjusted under 35 U.S.C. 154(b) by 4 days.

(21) Appl. No.: 14/095,024

(22) Filed: Dec. 3, 2013

(65) Prior Publication Data

US 2014/0161567 A1 Jun. 12, 2014

Related U.S. Application Data

(60) Provisional application No. 61/734,735, filed on Dec. 7, 2012.

(51) Int. Cl.
*E04B 2/88* (2006.01)
*E04G 21/16* (2006.01)

(52) U.S. Cl.
CPC ..... *E04G 21/167* (2013.01); *E04B 2/88* (2013.01)

(58) Field of Classification Search
None
See application file for complete search history.

(56) References Cited

U.S. PATENT DOCUMENTS 975,242 A 11/1910 Higgins et al.
1,199,077 A 9/1916 James
(Continued)

FOREIGN PATENT DOCUMENTS

CN 101177959 5/2008
DE 20 2009 002973 U1 6/2009
(Continued)

OTHER PUBLICATIONS

International Search Report and Written Opinion of the International Searching Authority for PCT/US2013/073465, dated Mar. 6, 2014 (9 pages).
(Continued)

*Primary Examiner* — Joshua J Michener
*Assistant Examiner* — Kyle Walraed-Sullivan
(74) *Attorney, Agent, or Firm* — Neal, Gerber & Eisenberg LLP

(57) ABSTRACT

Various embodiments of the present disclosure provide a curtain wall panel installation system. The curtain wall panel installation system of the present disclosure includes a plurality of rails each forming an elongated panel bracket spanning an entire edge or substantially the entire edge of a concrete floor slab of a given floor of a building. Each elongated panel bracket is mountable to anchors (such as embedments) cast in the concrete floor slab of a given floor of the building at discrete positions along the concrete floor. The elongated panel brackets enable the curtain wall panels to be laterally transported along the building façade to their respective installation positions, which enables workers to use a centralized crane location to hoist the curtain wall panels in preparation for installation.

11 Claims, 4 Drawing Sheets

(56) References Cited

U.S. PATENT DOCUMENTS

| | | | | |
|---|---|---|---|---|
| 1,382,082 | A | 6/1921 | Heltzel | |
| 1,643,578 | A | 9/1927 | Eaton et al. | |
| 2,301,306 | A | 11/1942 | McDonald | |
| 2,843,375 | A * | 7/1958 | Lesage | 49/220 |
| 2,971,616 | A | 2/1961 | Bayley, Jr. | |
| 3,124,222 | A | 3/1964 | Mote | |
| 3,219,308 | A | 11/1965 | Halstead | |
| 3,266,207 | A | 8/1966 | Birum, Jr. | |
| 3,266,210 | A | 8/1966 | Abraham | |
| 3,316,681 | A | 5/1967 | Eber | |
| 3,376,010 | A | 4/1968 | Myer | |
| 3,670,797 | A * | 6/1972 | Sassano | 160/118 |
| 3,685,235 | A * | 8/1972 | Lang | 52/39 |
| 3,719,014 | A | 3/1973 | Sukolics | |
| 3,722,165 | A | 3/1973 | Forsberg et al. | |
| 3,748,805 | A * | 7/1973 | Boros | 52/745.13 |
| 3,786,936 | A * | 1/1974 | Staadt | 212/291 |
| 3,791,094 | A * | 2/1974 | Shannon, Jr. | 52/747.1 |
| 3,797,191 | A | 3/1974 | Sukolics | |
| 3,857,497 | A * | 12/1974 | Shannon, Jr. | 414/11 |
| 3,912,218 | A | 10/1975 | Lister et al. | |
| 3,913,287 | A | 10/1975 | Chapman, Jr. | |
| 3,936,986 | A * | 2/1976 | Steel | 52/235 |
| 3,960,356 | A | 6/1976 | Adams | |
| 3,963,210 | A | 6/1976 | Macklin | |
| 3,974,608 | A | 8/1976 | Grearson | |
| 4,009,549 | A | 3/1977 | Hala | |
| 4,022,330 | A * | 5/1977 | Shannon, Jr. | 414/11 |
| 4,054,014 | A * | 10/1977 | van der Lely | 52/745.03 |
| 4,055,923 | A | 11/1977 | Biebuyck | |
| 4,074,486 | A | 2/1978 | Grearson | |
| 4,261,544 | A | 4/1981 | Addison | |
| 4,307,551 | A | 12/1981 | Crandell | |
| 4,418,506 | A | 12/1983 | Weber et al. | |
| 4,423,576 | A | 1/1984 | Farina et al. | |
| 4,506,482 | A | 3/1985 | Pracht et al. | |
| 4,543,755 | A | 10/1985 | Crandell | |
| 4,555,890 | A * | 12/1985 | Gartner | 52/745.11 |
| 4,577,450 | A | 3/1986 | Large | |
| 4,644,711 | A | 2/1987 | Eickhof | |
| 4,648,647 | A * | 3/1987 | Patton | 294/67.1 |
| 4,662,145 | A | 5/1987 | Tanikawa et al. | |
| 4,685,263 | A | 8/1987 | Ting | |
| 4,712,345 | A | 12/1987 | Kaminaga | |
| 4,738,065 | A | 4/1988 | Crandell | |
| 4,768,322 | A | 9/1988 | Kafarowski | |
| 4,782,635 | A | 11/1988 | Hegle | |
| 4,783,941 | A | 11/1988 | Loper et al. | |
| 4,798,035 | A | 1/1989 | Mitchell et al. | |
| 4,820,101 | A * | 4/1989 | Fenn | 414/21 |
| 4,831,805 | A | 5/1989 | Noborisaka et al. | |
| 4,883,590 | A | 11/1989 | Papp | |
| 4,899,508 | A | 2/1990 | Biebuyck | |
| 4,903,454 | A | 2/1990 | Rose | |
| 4,905,435 | A | 3/1990 | Horst | |
| 4,905,444 | A | 3/1990 | Semaan | |
| 4,951,438 | A | 8/1990 | Thoresen | |
| 5,048,254 | A | 9/1991 | Merlau | |
| 5,063,718 | A | 11/1991 | Nonis | |
| 5,067,272 | A | 11/1991 | Constantz | |
| 5,118,060 | A | 6/1992 | Spronken | |
| 5,239,798 | A | 8/1993 | Saito | |
| 5,240,543 | A | 8/1993 | Fetterhoff | |
| 5,390,468 | A | 2/1995 | Probst | |
| 5,449,542 | A | 9/1995 | Chiba et al. | |
| 5,548,939 | A | 8/1996 | Carmical | |
| 6,282,860 | B1 | 9/2001 | Ramirez | |
| 6,658,804 | B2 | 12/2003 | Leytes et al. | |
| 6,729,080 | B1 | 5/2004 | Zambelli et al. | |
| 7,533,501 | B2 | 5/2009 | Neal | |
| 7,681,366 | B2 | 3/2010 | De Gobbi | |
| 8,347,906 | B1 | 1/2013 | Ismert et al. | |
| 2003/0033764 | A1 | 2/2003 | Ting | |
| 2004/0079038 | A1 | 4/2004 | Crooker | |
| 2007/0039258 | A1 | 2/2007 | Walker | |
| 2008/0222981 | A1 | 9/2008 | De Gobbi | |
| 2009/0084747 | A1* | 4/2009 | Heinaman | 212/181 |
| 2010/0257812 | A1 | 10/2010 | Schultz et al. | |
| 2011/0036043 | A1* | 2/2011 | Heinaman | B66C 1/105 52/741.1 |
| 2011/0107712 | A1* | 5/2011 | Inoue et al. | 52/655.1 |
| 2012/0210658 | A1* | 8/2012 | Logan | E04B 2/88 52/173.1 |
| 2013/0051903 | A1 | 2/2013 | Ra | |
| 2014/0013685 | A1* | 1/2014 | Coleman et al. | 52/235 |

FOREIGN PATENT DOCUMENTS

| | | |
|---|---|---|
| EP | 1 467 038 A1 | 10/2004 |
| EP | 1 688 551 A1 | 8/2006 |
| JP | H06 200630 | 7/1997 |
| JP | 2001 020528 | 1/2001 |
| WO | WO 01/80474 A2 | 10/2001 |

OTHER PUBLICATIONS

Canadian Office Action for Canadian Application No. 2,894,150, dated Feb. 24, 2016 (3 pages).

* cited by examiner

CURTAIN WALL PANEL INSTALLATION SYSTEM

PRIORITY CLAIM

This application claims priority to and the benefit of U.S. Provisional Patent Application No. 61/734,735, filed on Dec. 7, 2012, the entire contents of which are incorporated herein by reference.

BACKGROUND

Building envelopes of certain commercial and mixed use residential buildings include a curtain wall. The curtain wall of a building defines the appearance of the building and, more importantly, separates the interior controlled or conditioned space from the outside environment. The curtain wall is usually formed from a plurality of curtain wall panels that typically contain glass, metal, and/or stone. The curtain wall panels are attached to the building's structural elements via anchors and curtain wall panel hanging brackets (sometimes referred to as curtain wall panel brackets or panel brackets). The anchors are located at discrete attachment points along the edges of the building's concrete floor slabs. The anchors typically include embedments (sometimes referred to as embeds) that are each cast into a concrete floor slab and that may be located on the top of the slab, on the face of the slab, or beneath the slab. A panel bracket is attached to each embedment, and a curtain wall panel is hung from each panel bracket.

For a given concrete floor slab, before the concrete that forms that concrete floor slab is poured into the concrete form, an array of rebar, metallic cables, and/or other material used to reinforce the concrete floor slab is installed within the concrete form. Embedments are then positioned along an edge of the concrete form by a one or more workers using a tape measure and control lines provided by the general contractor. That is, the worker typically uses the tape measure to hand measure where to position each embedment along the edge of the concrete form using the control lines for reference, though in certain instances the embedments are positioned along the edge of the concrete form with the aid of survey equipment.

This installation process requires another measurement by the worker to assure the embedment has the proper edge spacing from the concrete form (i.e., to ensure the embedment is located at the proper distance from the edge of the concrete form). More specifically, after determining the position along the edge of the concrete form at which to attach the embedment, the worker must then use the tape measure to hand measure the distance of the embedment from the edge of the concrete form. The worker then anchors the embedment into place by either nailing the embedment to the concrete form, wire tying the embedment to rebar, or wire tying the embedment to scraps of lumber and then nailing the lumber to the concrete form such that the anchored embedment has the proper edge spacing from, and is positioned at the desired position along the edge of, the concrete form.

Concrete is then poured into the concrete form, typically via a high pressure concrete pumping hose. Concrete pumping hoses are heavy and unwieldy, and typically require multiple workers to control and operate the concrete pumping hose while walking on and around the rebar, metallic cables, and/or other reinforcing materials within the concrete form. As and after the concrete is being poured (pumped) into the concrete form, several workers level the poured concrete, which again involves the workers walking on and around the rebar, metallic cables, and/or other reinforcing materials. This movement, shifting, and jostling of the rebar, metallic cables, and/or other reinforcing materials, along with the vibration of the concrete pumping hose and the movement of the poured concrete itself, is problematic because it may alter the position of one or more of the embedments or dislodge one or more of the embedments.

Sometime after the concrete has been poured, each embedment must be located and exposed, which sometimes requires workers to chip away any concrete that may be covering the embedment. After the embedments are located and exposed, a survey is conducted to determine whether any of the embedments are potentially problematic. More specifically, the survey is conducted to determine whether any embedments are missing, any embedments are buried too deep within the concrete floor slab, any embedments are improperly positioned or misaligned, and/or whether any embedments conflict with other features of the building, in which case a panel bracket may not be able to be safely or properly mounted to that embedment. After the survey is completed, any problematic embedments must be fixed before construction can continue.

After any problematic embedments are fixed, workers mount a separate, individual panel bracket to each embedment using fasteners. Certain curtain wall panels include attachment fixtures that "hang" onto the panel brackets such that the curtain wall panels hang off of the panel brackets. These attachment fixtures often include a mechanism that enables some level adjustment to aid in leveling the curtain wall panels. These leveling mechanisms are seldom used, however, because they increase the time it takes to the hang the curtain wall panels, thereby increasing installation costs due to labor and equipment (such as cranes). As a result, the panel brackets are usually leveled per floor prior to the installation of the curtain wall panels. More specifically, for each floor of the building, the panel brackets on that floor are leveled relative to one another such that they are all planar and at a same elevation to ensure that the installed curtain wall will be level after the curtain wall panels are craned into position.

After the individual panel brackets are leveled, workers hoist the individual curtain wall panels and hang them onto the panel brackets at their respective final positions. The workers use a tower crane, truck crane, or mini crane to hoist and maneuver the curtain wall panels. Thus, in typical curtain wall installations, one curtain wall panel at a time is hoisted into position and hung off of one or more panel brackets. This one-at-a-time method of installing the curtain wall panels is necessitated by the use of discrete anchoring locations for the embedments and separate, individual panel brackets mounted to each embedment.

This one-at-a-time method of installing the curtain wall panels is time-consuming and expensive. If a mini crane is used to hoist and install the curtain wall panels, following the installation of each curtain wall panel or every other curtain wall panel, workers must reposition the mini-crane such that it is positioned directly over the next curtain wall panel's installation location. This constant repositioning of the mini-crane during installation extends installation time, which increases crane rental costs and labor costs, and increases the difficulty of installation and the likelihood of operator error during installation. In instances in which a tower crane or a truck crane is used to hoist and install the curtain wall panels, certain parts of the crane must be maneuvered (such as by rotating and/or extending or retracting the jib) prior to the hoisting and installation of each curtain panel to enable that curtain watt panel to be installed at the desired location. This constant repositioning of the parts of the tower or truck crane during installation also extends installation time, which increases crane rental costs and labor costs, and increases the difficulty of installation and the likelihood of operator error during installation.

Accordingly, there is a need for new apparatuses and methods for expediting the installation of curtain wall panels that solve the above problems.

SUMMARY

Various embodiments of the present disclosure provide a curtain wall panel installation system. The curtain wall panel installation system of the present disclosure includes a plurality of rails each forming an elongated panel bracket spanning an entire edge or substantially the entire edge of a concrete floor slab of a given floor of a building. Each elongated panel bracket is mountable to anchors (such as embedment s) cast in the concrete floor slab of a given floor of the building at discrete positions along the concrete floor. The elongated panel brackets enable the curtain wall panels to be laterally transported along the building façade to their respective installation positions, which enables workers to use a centralized crane location to hoist the curtain wall panels in preparation for installation.

In one embodiment, the curtain wall panel installation system includes a first elongated panel bracket mountable to a first plurality of anchors; a trolley slidably mountable to the first elongated panel bracket and configured to move relative to the first elongated panel bracket when slidably mounted to the first elongated panel bracket; and a second elongated panel bracket mountable to a second plurality of anchors such that, when the trolley is slidably mounted to the first elongated panel bracket, a curtain wall panel removably attached to the trolley can be mounted to the second elongated panel bracket.

In another embodiment, the curtain wall panel installation system includes a first elongated panel bracket mountable to a first plurality of anchors; a trolley slidably mountable to the first elongated panel bracket and configured to move relative to the first elongated panel bracket when slidably mounted to the first elongated panel bracket; and a second elongated panel bracket mountable to a second plurality of anchors such that, when the trolley is slidably mounted to the first elongated panel bracket, a plurality of curtain wall panels can be sequentially mounted to the second elongated panel bracket using the trolley.

In a further embodiment, the curtain wall panel installation system includes a first elongated panel bracket mountable to a first plurality of anchors; a trolley including one or more curtain wall panel attachers to which a curtain wall panel can removably attach, the trolley being slidably mountable to the first elongated panel bracket and configured to move relative to the first elongated panel bracket when slidably mounted to the first elongated panel bracket, wherein the trolley is removable from the first elongated panel bracket after being slidably mounted to the first elongated panel bracket; and a second elongated panel bracket mountable to a second plurality of anchors positioned below the first plurality of anchors such that, when the trolley is slidably mounted to the first elongated panel bracket, a plurality of curtain wall panels can be sequentially mounted to the second elongated panel bracket using the trolley.

Because the curtain wall panel installation system of the present disclosure enables workers to use a centralized crane hoist location, the curtain wall panel installation system eliminates the need to constantly reposition the crane or parts of the crane during installation, which reduces installation time and associated crane rental costs and labor costs, increases the ease of installation of the curtain wall, and decreases the likelihood of operator error during installation. In certain embodiments, the curtain wall panel installation system of the present disclosure also reduces the number of anchors required to be cast in the concrete floor slab, reduces or eliminates interference of anchor locations with other parts of the building (such as columns), and reduces or eliminates the need for custom anchors. Additionally, the curtain wall panel installation system of the present disclosure facilitates retrofitting of the building with different curtain wall panels because the curtain wall panel installation system can accommodate any size panel and is not limited by particular anchor (and corresponding panel bracket) locations.

Additional features and advantages of the present invention are described in, and will be apparent from, the following Detailed Description and the Figures.

DETAILED DESCRIPTION OF EXAMPLE EMBODIMENTS

Various embodiments of the present disclosure provide a curtain wall panel installation system. The curtain wall panel installation system of the present disclosure includes a plurality of rails each forming an elongated panel bracket spanning an entire edge or substantially the entire edge of a concrete floor slab (or other structural element) of a given floor of a building. Each elongated panel bracket is mountable to anchors (such as embedments) cast in the concrete floor slab of a given floor of the building at discrete positions along the concrete floor slab (and is thus anchorable to the building). It should be appreciated that the elongated panel bracket of the present disclosure is configured to be leveled before installation of the curtain watt panels. As described in detail below, the elongated panel brackets enable the curtain watt panels to be laterally transported along the building façade to their respective installation positions, which enables workers to use a centralized crane location to hoist the curtain wall panels in preparation for installation.

Curtain Wall Panel Installation System Including an Overhead Trolley

Figure 1:
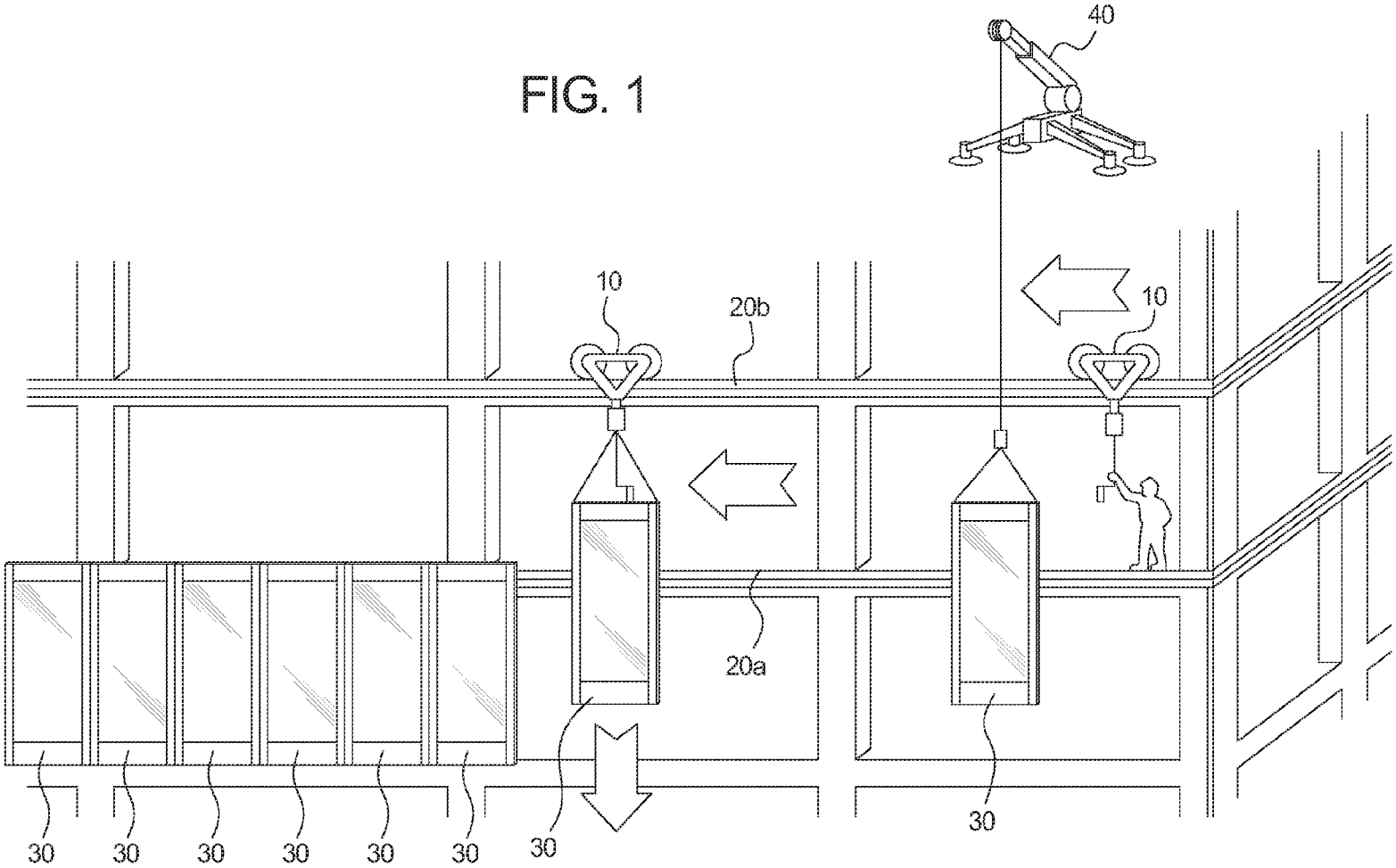
FIG. 1 illustrates a perspective view of an example embodiment of the curtain wall panel installation system including an overhead trolley of the present disclosure.

Turning now to the Figures and particularly to FIG. 1, in one embodiment, the curtain wall panel installation system of the present disclosure includes one or more overhead trolleys. More specifically, in this illustrated embodiment, the curtain wall panel installation system includes: (a) a first elongated panel bracket 20*a*, (b) a second elongated panel bracket 20*b*, and (c) a plurality of trolleys 10. The first elongated panel bracket 20*a* and the second elongated panel bracket 20*b* are each mountable to a plurality of anchors, such as embedments, cast in a concrete floor slab of a given floor of a building. Each trolley 10 is slidably mountable to the elongated panel brackets 20*a* and 20*b* such that that trolley 10 can translate along and relative to the elongated panel bracket to which that trolley 10 is mounted.

In operation, to install a plurality of curtain wall panels 30 on the first elongated panel bracket 20*a*, one or more workers first: (a) mount the first elongated panel bracket 20*a* to a plurality of anchors (not shown) cast in a concrete floor slab of a first floor, (b) mount the second elongated panel bracket 20*b* to a plurality of anchors (not shown) cast in a concrete floor slab of a second floor located above the first floor, and (c) slidably mount the trolleys 10 to the upper floor elongated panel bracket 20*b*. For each individual curtain wall panel 30, to install that curtain wall panel 30 on the first elongated panel bracket 20*a*, the workers use a crane 40 (such as a mini crane) to hoist and position the curtain wall panel 30 such that the curtain wall panel 30 can be removably attached to the trolley 10. The workers removably attach the curtain wall panel 30 to the trolley 10 by using any suitable curtain wall panel attacher, such as one or more hooks. The workers then transport the trolley 10 (and, therefore, the curtain wall panel 30 attached to the trolley 10) along the second elongated panel bracket 20*b*, such as by using a motor, by manually pushing, or by using a hand crank, until that curtain wall panel 30 is located at its desired installation position relative to the first elongated panel bracket 20*a*. The workers then lower that curtain wall panel 30 into its seated position, such as by using a motor or a hand crank, and mount the curtain wall panel 30 to the first elongated panel bracket 20*a*. This process is repeated for remaining each curtain wall panel 30 to be installed on the first elongated panel bracket 20*a*.

After the curtain wall panels 30 are installed on the first elongated panel bracket 20*a*, the workers remove the trolleys 10 from the second elongated panel bracket 20*b*. The workers slidably mount the trolleys 10 to an elongated panel bracket (not shown) mounted to a plurality of anchors cast in a concrete floor slab of a third floor located above the second floor. The workers then repeat the above-described procedure to install curtain wall panels on the second elongated panel bracket 20*b*. It should thus be appreciated that the elongated panel brackets of the curtain wall panel installation system of the present disclosure serve a dual purpose in this embodiment: (a) they facilitate the installation of the curtain wall panels on other elongated panel brackets, and (b) they serve as mounts for the curtain wall panels. It should further be appreciated that the elongated panel bracket of the present disclosure remain attached to the building (e.g., mounted to the embedments) after the curtain wall panels are installed.

It should be appreciated that, in certain embodiments, the curtain wall panels to be installed on the elongated panel bracket mounted to anchors in the concrete floor slab of a top floor of the building may have to be individually installed without the use of trolleys because there is no elongated panel bracket located above that elongated panel bracket on which the trolleys may be slidably mounted.

In various embodiments, elongated panel brackets define one or more channels therethrough. In these embodiments, various components, such as electrical conduit and/or wiring, lighting fixtures (such as LED light strips), telephone wiring, cable or satellite television wiring, internet wiring, fiber-optic cables, LAN wiring, and the like, may be routed through the channels of the elongated panel brackets. In certain such embodiments, the channels are configured such that the interiors of the channels are not visible from the outside of the building looking inward, while in other such embodiments, the channels are configured such that the interior of the channels are visible from the outside of the building looking inward. For instance, in embodiments in which the channels are configured to house unsightly electrical wiring, the elongated panel brackets are configured such that the interior of the channel and the components housed therein are not visible. In another example embodiment in which the channels are configured to house decorative components, such as lighting, the elongated panel brackets are configured such that the interior of the channel and the components housed therein are visible.

Curtain Wall Panel Installation System Including a Rail Roller

Figure 2:
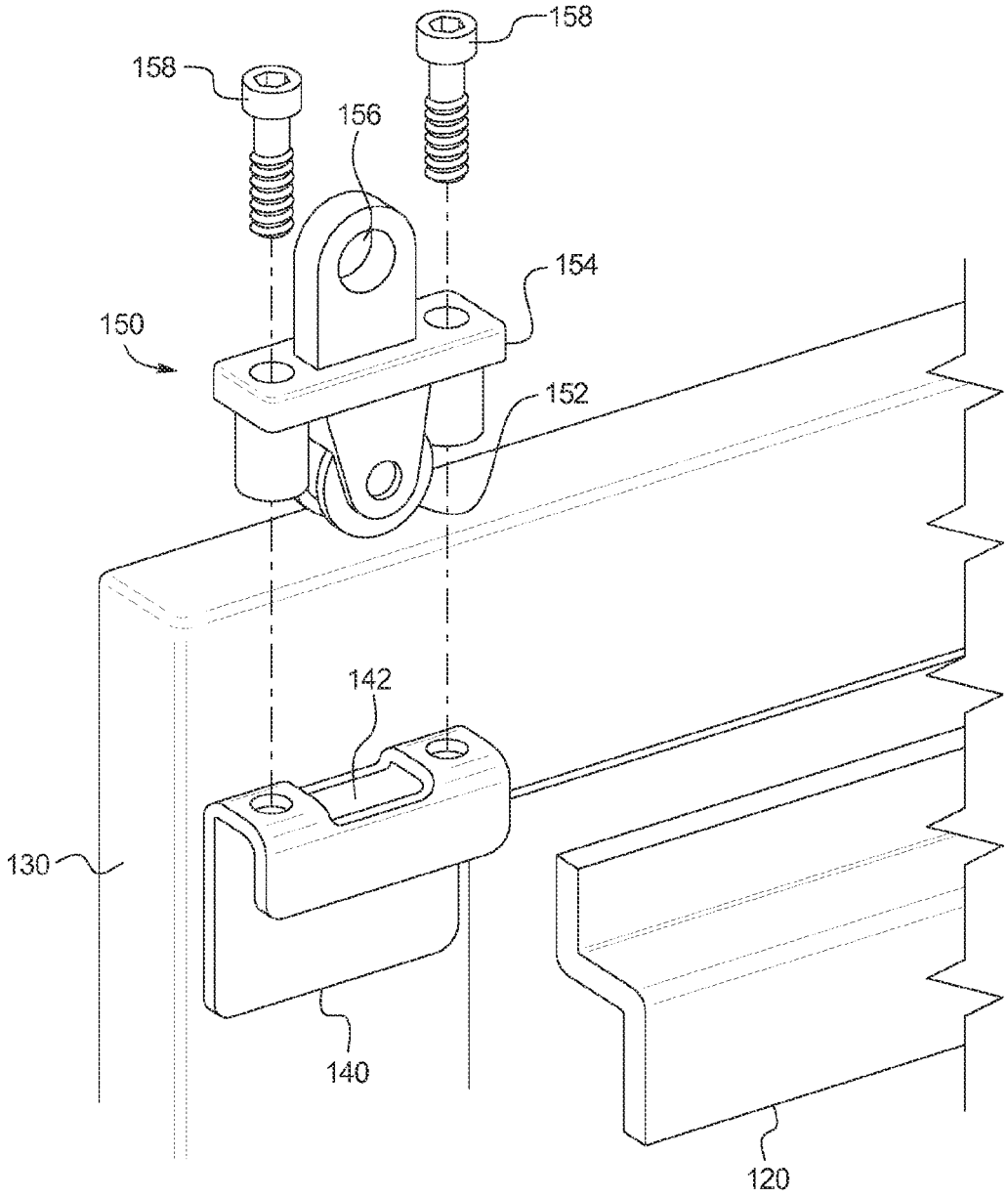
FIG. 2 illustrates a perspective view of an example embodiment of the curtain wall panel installation system including a rail roller of the present disclosure.

Turning now to FIG. 2, in another embodiment, the curtain wall panel installation system of the present disclosure includes a rail roller. More specifically, in this illustrated embodiment, the curtain wall panel installation system includes: (a) an elongated panel bracket 120, (b) a plurality of rail roller receiving brackets 140 (only one of which is shown in FIG. 2) attached to a curtain wall panel 130, and (c) a plurality of rail rollers 150 (only one of which is shown in FIG. 2) that are removably attachable to the rail roller receiving brackets 140. Each rail roller 150 includes a mounting bracket 154 and a roller 152 (such as a wheel) connected to a bottom of the mounting bracket 154, and defines a hoist receiving opening 156 therethrough, which is configured to removably attach to a hoist of a crane (not shown). Each rail roller receiving bracket 140 defines a roller receiving opening 142 therethrough that is configured to receive the roller 152 of one of the rail rollers 150.

In operation, to install the curtain wall panel 130 on the elongated panel bracket 120 using the rail rollers 150, one or more workers attach the rail rollers 150 to corresponding rail roller receiving brackets 140 using fasteners 158. When attached to the rail roller receiving brackets 140, the rollers 152 are received by and protrude beneath the roller receiving openings 142 of the respective roller receiving brackets 140. The workers then use a crane (not shown) to hoist and position the curtain wall panel 130 such that the rollers 152 engage and are configured to roll along and relative to the elongated panel bracket 120.

Once the curtain wall panel 130 is positioned as such, the workers may roll (via the rollers 152) the curtain wall panel 130 along and relative to the elongated panel bracket 120 and into its desired installation position. Once the curtain wall panel 130 is in its desired installation position, the workers may unfasten the rail rollers 150 from the rail roller receiving brackets 140 by removing the fasteners 158. This causes the curtain wall panel 130 to lower into its seated position. The workers may then, if desired, reuse the rail rollers 150 to install another curtail wall panel.

Curtain Wall Panel Installation System Including a Rail Lever Roller

Figure 3:
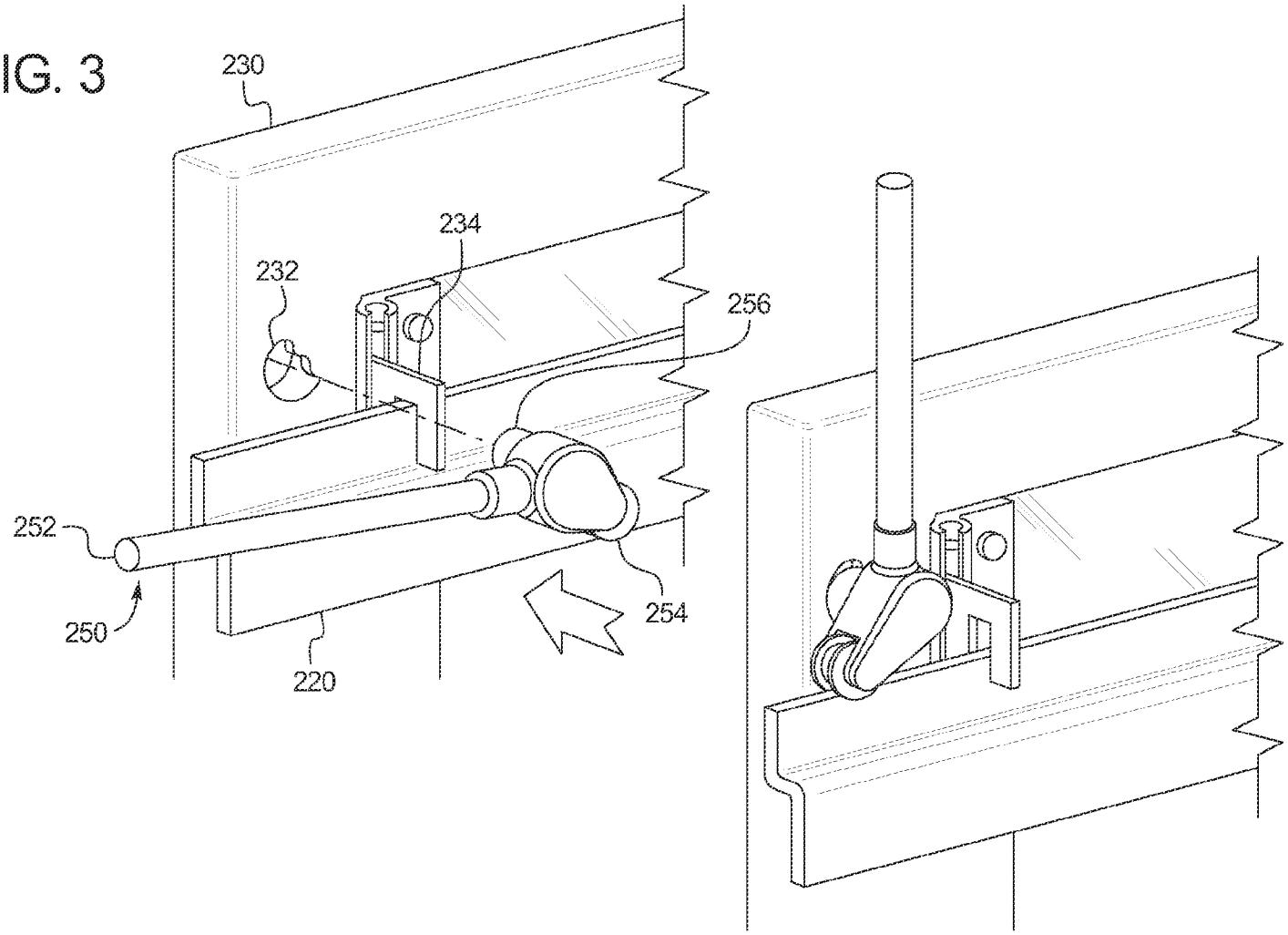
FIG. 3 illustrates perspective views of an example embodiment of the curtain wall panel installation system including a rail lever roller of the present disclosure.

Turning now to FIG. 3, in another embodiment, the curtain wall panel installation system of the present disclosure includes a rail lever roller. More specifically, in this illustrated embodiment, the curtain wall panel installation system includes: (a) an elongated panel bracket 220, (b) a curtain wall panel 230, and (c) a plurality of rail lever rollers 250 (only one of which is shown in FIG. 3). Each rail lever roller 250 includes: (a) a lever handle 252, (b) a pivoting cam lock 256, and (c) a roller 254 (such as a wheel). The curtain wall panel 230: (a) defines a plurality of cam lock receiving openings 232 (only one of which is shown in FIG. 3) partially therethrough that are configured to receive the cam locks 256 of the rail lever rollers 250, and (b) includes a plurality of hangers 234 (only one of which is shown in FIG. 3).

In operation of one embodiment, to install the curtain wall panel 230 on the elongated panel bracket 220 using the rail lever rollers 250, one or more workers use a crane (not shown) to hoist and position the curtain wall panel 230 such that the hangers 234 engage and rest on the elongated panel bracket 220. Thereafter, the workers position the cam locks 256 of the rail lever rollers 250 such that the mating profiles of the cam locks 256 are aligned with those of the cam lock receiving openings 232 of the curtain wall panel 230 and insert the cam locks 256 into the respective cam lock receiving openings 232. The workers then rotate the lever handles 252 of the rail lever rollers 250 clockwise such that the rollers 254 are in a downward position, which raises the curtail wall panel 230 such that the hangers 234 disengage from the elongated panel bracket 220 and such that the rollers 254 engage and are configured to roll along and relative to the elongated panel bracket 220. It should be appreciated that the off-center location of the rollers 254 (relative to the lever handle 252 as shown in FIG. 3) and the pivot points of the rail lever rollers 250 ensure that the rail lever rollers 250 remain in this position until otherwise manipulated by the workers.

The workers may then roll the curtain wall panel 230 along and relative to the elongated panel bracket 220 and into its desired installation position using the rollers 254 of the rail lever rollers 250. Once the curtain wall panel 230 is in its desired installation position, the workers then rotate the lever handles 252 of the rail lever rollers 250 counter-clockwise such that the rollers 254 are in an upward position, which lowers the curtail wall panel 230 such that the hangers 234 engage and rest on the elongated panel bracket 220. The workers may then, if desired, remove the cam locks 256 from the respective cam lock receiving openings 232 and re-use the rail lever rollers 250 to install another curtain wall panel or to reposition an already-installed curtain wall panel.

In operation of another embodiment, to install the curtain wall panel 230 on the elongated panel bracket 220 using the rail lever rollers 250, one or more workers position the cam locks 256 of the rail lever rollers 250 such that the mating profiles of the cam locks 256 are aligned with those of the cam lock receiving openings 232 of the curtain wall panel 230 and insert the cam locks 256 into the respective cam lock receiving openings 232. The workers then rotate the lever handles 252 of the rail lever rollers 250 clockwise such that the rollers 254 are in the downward position. The workers then use a crane (not shown) to hoist and position the curtain wall panel 230 such that the rollers 254 engage and are configured to roll along and relative to the elongated panel bracket 230. Once the curtain wall panel 230 is positioned as such, the workers may roll the curtain wall panel 230 along and relative to the elongated panel bracket 220 and into its desired installation position using the rollers 254 of the rail lever rollers 250. Once the curtain wall panel 230 is in its desired installation position, the workers then rotate the lever handles 252 of the rail lever rollers 250 counter-clockwise such that the rollers 254 are in the upward position, which lowers the curtail wall panel 230 such that the hangers 234 engage and rest on the elongated panel bracket 220. The workers may then, if desired, remove the cam locks 256 from the respective cam lock receiving openings 232 and re-use the rail lever rollers 250 to install another curtain wall panel or to reposition an already-installed curtain wall panel.

Curtain Wall Panel Installation System Including a Rail Cam Roller

Figure 4:
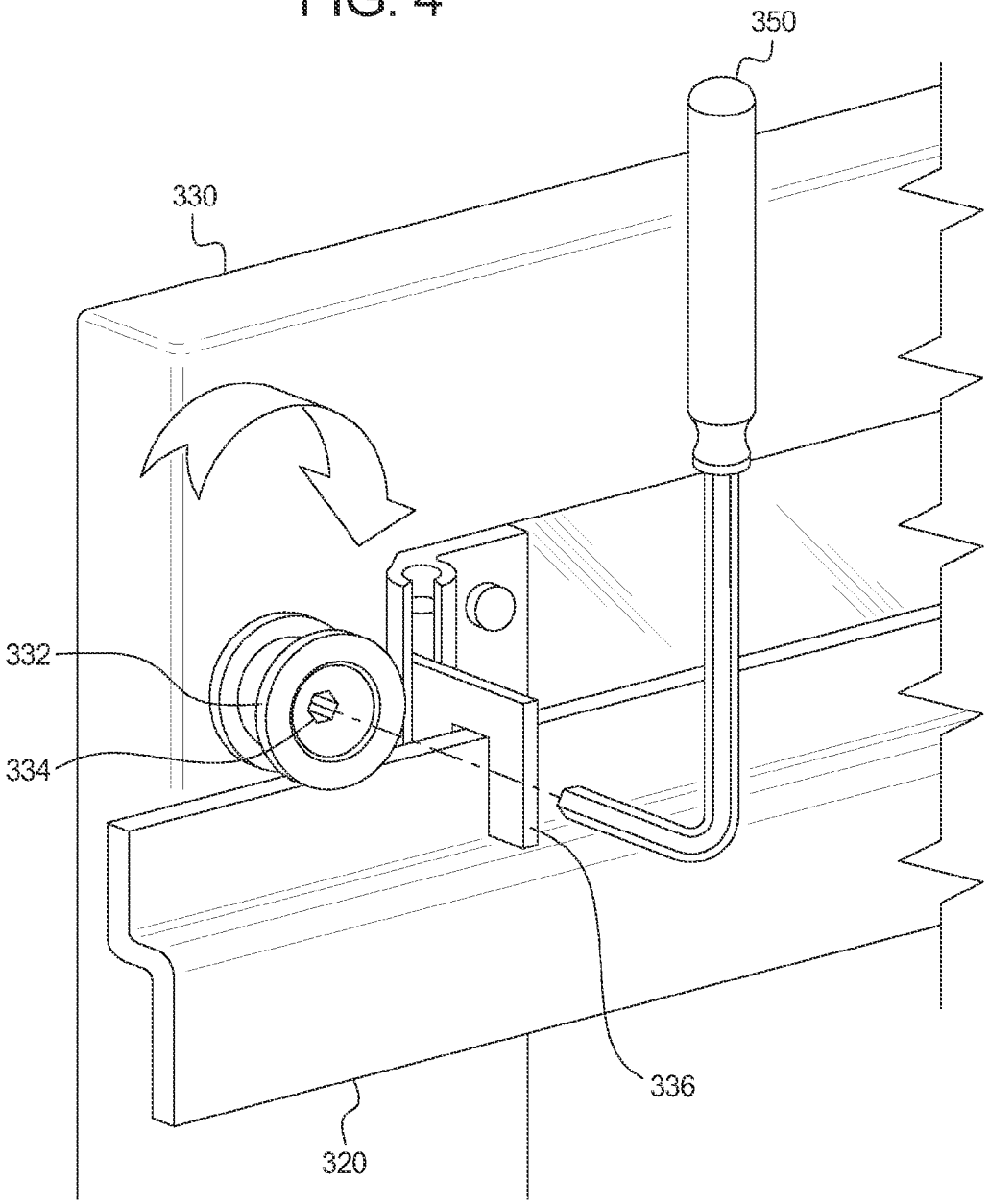
FIG. 4 illustrates a perspective view of an example embodiment of the curtain wall panel installation system including a rail cam roller of the present disclosure.

Turning now to FIG. 4, in another embodiment, the curtain wall panel installation system of the present disclosure includes a rail cam roller. More specifically, in this illustrated embodiment, the curtain wall panel installation system includes: (a) an elongated panel bracket 320, and (b) a curtain wall panel 330 including a plurality of rollers 332 (only one of which is shown in FIG. 4), such as wheels, each defining a cam profile 334 at least partially therethrough, and a plurality of hangers 336 (only one of which is shown in FIG. 4).

In operation of one embodiment, to install the curtain wall panel 330 on the elongated panel bracket 320, one or more workers use a crane to lower the curtain wall panel 330 onto the elongated panel bracket 320 such that the hangers 356 engage the elongated panel bracket 320. The workers insert wrenches 350 (only one of which is shown in FIG. 4), such as Allen wrenches, into the cam profiles 334 of the rollers 332 and rotate the wrenches 350 clockwise such that the rollers 332 are in a downward position, which raises the curtain wall panel 330 such that the hangers 356 disengage from the elongated panel bracket 320 and the rollers 332 engage and are configured to roll along and relative to the elongated panel bracket 330. The workers may then roll the curtain wall panel 330 (via the rollers 332) along the elongated panel bracket 320 into its desired installation position. Once the curtain wall panel 330 is in its desired installation position, the workers may rotate the wrenches 350 counterclockwise to lower the curtain wall panel 330 onto the elongated panel bracket 320 into its seated position. It should be appreciated that if the curtain wall panel needs to be moved, the workers can simply re-insert the wrenches into the earn profiles or the rollers, raise the curtain wall panel, and move it as desired.

In operation of another embodiment, to install the curtain wall panel 330 on the elongated panel bracket 320, one or more workers insert the wrenches 350 into the cam profiles 334 of the rollers 332 and rotate the wrenches 350 clockwise such that the rollers 332 are in the downward position. The workers then use a crane to lower the curtain wall panel 330 onto the elongated panel bracket 320 such that the rollers 332 engage and are configured to roll along and relative to the elongated panel bracket 320. Once the curtain wall panel 330 is positioned as such, the workers may roll the curtain wall panel 330 (via the rollers 332) along the elongated panel bracket 320 into its desired installation position. Once the curtain wall panel 330 is in its desired installation position, the workers may rotate the wrenches 350 counter-clockwise to lower the curtain wall panel 330 onto the elongated panel bracket 320 into its seated position. It should be appreciated that if the curtain wall panel needs to be moved, the workers can simply re-insert the wrenches into the cam profiles or the rollers, raise the curtain wall panel, and move it as desired.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A curtain wall panel installation system comprising:

a first elongated curtain wall panel bracket attached to and extending between a first plurality of laterally spaced-apart embedments cast in a first floor slab of a building, the first elongated curtain wall panel bracket being wider than a combined width of a first plurality of curtain wall panels and configured so the first plurality of curtain wall panels can be simultaneously attached thereto;

a trolley mounted to the first elongated curtain wall panel bracket such that the trolley is movable along and relative to the first elongated curtain wall panel bracket; and a second elongated curtain wall panel bracket attached to and extending between a second plurality of laterally spaced-apart embedments cast in a second lower floor slab of the building, the second elongated curtain wall panel bracket being wider than a combined width of a second different plurality of curtain wall panels and configured so the second plurality of curtain wall panels can be simultaneously attached to the second elongated curtain wall panel bracket.

2. The curtain wall panel installation system of claim 1, wherein the trolley is removable from the first elongated curtain wall panel bracket and also mountable to the second elongated curtain wall panel bracket.

3. The curtain wall panel installation system of claim 1, wherein at least part of the trolley is rollable along the first elongated curtain wall panel bracket.

4. The curtain wall panel installation system of claim 1, wherein the first elongated curtain wall panel bracket includes a first outwardly-extending wall extending generally parallel to an outer face of the first floor slab and a first upwardly-extending wall extending generally parallel to the outer face of the first floor slab, the first outwardly-extending and upwardly-extending walls defining a track.

5. The curtain wall panel installation system of claim 4, wherein the trolley is at least partially disposed within the track.

6. The curtain wall panel installation system of claim 4, wherein the first outwardly-extending wall and the first upwardly-extending wall form a curtain wall panel mount.

7. The curtain wall panel installation system of claim 4, wherein the second elongated curtain wall panel bracket includes a second outwardly-extending wall extending generally parallel to an outer face of the second floor slab and a second upwardly-extending wall extending generally parallel to the outer face of the second floor slab.

8. The curtain wall panel installation system of claim 7, wherein the second outwardly-extending wall and the second upwardly-extending wall form a curtain wall panel mount.

9. The curtain wall panel installation system of claim 1, which includes a curtain wall panel including a plurality of rail roller receiving brackets and a plurality of rail rollers, each of the rail rollers being removably attached to one of the rail roller receiving brackets such that the curtain wall panel is movable relative to the elongated curtain wall panel bracket via the plurality of rail rollers.

10. The curtain wall panel installation system of claim 1, which includes the second plurality of curtain wall panels simultaneously attached to the second elongated curtain wall panel bracket.

11. A curtain wall panel installation method comprising:

attaching a first elongated curtain wall panel bracket to a first plurality of laterally spaced-apart embedments cast in a first floor slab of a building;

attaching a second elongated curtain wall panel bracket to a second plurality of laterally spaced-apart embedments cast in a second floor slab of the building below the first floor slab, the second elongated curtain wall panel bracket being wider than a combined width of a first plurality of curtain wall panels;

attaching a third elongated curtain wall panel bracket to a third plurality of laterally spaced-apart embedments cast in a third floor slab of the building below the second floor slab, the third elongated curtain wall panel bracket being wider than a combined width of a second plurality of curtain wall panels;

mounting a trolley to the second elongated curtain wall panel bracket such that the trolley is movable along and relative to the second elongated curtain wall panel bracket;

using the trolley, sequentially attach the second plurality of curtain wall panels to the third elongated curtain wall panel bracket;

afterwards, removing the trolley from the second elongated curtain wall panel bracket and mounting the trolley to the first elongated curtain wall panel bracket such that the trolley is movable along and relative to the first elongated curtain wall panel bracket; and using the trolley, sequentially attach the first plurality of curtain wall panels to the second elongated curtain wall panel bracket.

* * * * *